US008771028B2

(12) United States Patent
Tonosaki

(10) Patent No.: US 8,771,028 B2
(45) Date of Patent: Jul. 8, 2014

(54) CONNECTION STRUCTURE FOR CONNECTING A TERMINAL FITTING AND A CIRCUIT BOARD

(75) Inventor: Takashi Tonosaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 59 days.

(21) Appl. No.: 13/555,573

(22) Filed: Jul. 23, 2012

(65) Prior Publication Data

US 2013/0034976 A1 Feb. 7, 2013

(30) Foreign Application Priority Data

Aug. 4, 2011 (JP) ..... 2011-170595

(51) Int. Cl.
*H01R 13/02* (2006.01)

(52) U.S. Cl.
USPC ..... 439/886; 439/82; 439/151

(58) Field of Classification Search
USPC ..... 439/82, 751, 886
See application file for complete search history.

(56) References Cited

U.S. PATENT DOCUMENTS

| | | | | |
|---|---|---|---|---|
| 5,073,119 | A * | 12/1991 | Soes | 439/82 |
| 5,916,695 | A * | 6/1999 | Fister et al. | 428/647 |
| 6,296,534 | B1 * | 10/2001 | Yi | 439/876 |
| 6,764,318 | B1 * | 7/2004 | Fajardo | 439/82 |
| 6,875,032 | B2 | 4/2005 | Tsuchiya | |
| 6,896,559 | B2 * | 5/2005 | Klein et al. | 439/733.1 |
| 7,377,823 | B2 * | 5/2008 | Chen | 439/751 |
| 2006/0264076 | A1 | 11/2006 | Chen | |
| 2009/0117755 | A1 * | 5/2009 | Tonosaki | 439/55 |
| 2013/0034976 | A1 * | 2/2013 | Tonosaki | 439/84 |

FOREIGN PATENT DOCUMENTS

| | | |
|---|---|---|
| DE | 102006057143 | 6/2008 |
| JP | 2008294299 | 12/2008 |

* cited by examiner

*Primary Examiner* — James Harvey
(74) *Attorney, Agent, or Firm* — Gerald E. Hespos; Michael J. Porco; Matthew T. Hespos

(57) ABSTRACT

A board connecting portion (21) of a terminal fitting (20) is inserted in a through hole (11) of a circuit board (10). Two resilient deformation portions (22) formed at the board connecting portion (21) are deformed resiliently to approach each other and are held resiliently in contact with the inner periphery of the through hole (11). Copper plating layers (25) formed on the outer surfaces of the resilient deformation portions (22) and a board-side tin plating layer (13) formed on the inner peripheral surface of the through hole (11) are alloyed to hold the board connecting portion (21) in the through hole (11).

12 Claims, 4 Drawing Sheets

CONNECTION STRUCTURE FOR CONNECTING A TERMINAL FITTING AND A CIRCUIT BOARD

BACKGROUND OF THE INVENTION

1. Field of the Invention

The invention relates to a connection structure for connecting a terminal fitting and a circuit board.

2. Description of the Related Art

U.S. Patent No. 6,875,032 discloses a connection structure for connecting a circuit board and a terminal fitting. The circuit board is formed with a through hole, and a board connecting portion of the terminal fitting is formed with the resilient deformation portions. In a state where the board connecting portion is inserted in the through hole, The resilient deformation portions are deformed resiliently to approach one another. The resilient deformation portions are held resiliently in contact with the inner periphery of the through hole by their own resilient restoring forces, so that the terminal fitting and the circuit board are connected electrically conductively.

Only resilient forces of the resilient deformation portions are utilized for holding the terminal fitting in the through hole in the above connection structure, and a more reliable holding performance is desired.

The invention was completed in view of the above situation and an object thereof is to improve connection strength between a circuit board and a terminal fitting.

SUMMARY OF THE INVENTION

The invention relates to a connection structure for connecting a circuit board and a terminal fitting. The connection structure includes a circuit board with at least one hole and a terminal fitting with a board connecting portion that has resilient deformation portions. The resilient deformation portions can be deformed resiliently in a direction intersecting an inserting direction of the terminal fitting into the hole and held resiliently in contact with the inner periphery of the hole when the board connecting portion is inserted in the hole. A first metal plating layer made of a first metal is formed on the outer surface of each resilient deformation portion or the inner peripheral surface of the hole and a second plating layer made of a second metal different from the first metal is formed on the other surface. The first and second metal plating layers are brought resiliently into contact to be alloyed and the board connecting portion is held in the hole.

The inner peripheral surface of the through hole and the outer surfaces of the resilient deformation portions are fixed firmly by alloying the first and second metal plating layers to improve a connection strength between the circuit board and the terminal fitting.

The second metal plating layer of the second metal preferably is formed on the surface where the first metal plating layer is formed and the second metal plating layer preferably is formed on the surface where the first metal plating layer is not formed. The second metal plating layer arranged near the first metal plating layer contact each other to form a good conductive area having higher conductivity than an alloyed area formed by resilient contact of the first metal plating layer and the second metal plating layer.

A tin plating layer preferably is formed on the surface where the copper plating layer is formed so as to be arranged near the copper plating layer. The tin plating layer formed on the surface where the copper plating layer is not formed and the tin plating layer arranged near the copper plating layer contact each other to form a good conductive area having higher conductivity than an alloyed area formed by resilient contact of the copper plating layer and the tin plating layer.

The good conductive area having high conductivity is provided in addition to the alloyed area having high fixing strength in contact areas of the outer surfaces of the resilient deformation portions and the inner peripheral surface of the through hole. Thus, the reliability of the fixing strength between the circuit board and the terminal fitting is excellent and the reliability of electrical performance is excellent.

At least one projection may be formed on the outer surface of the resilient deformation portion for biting into and engaging the inner peripheral surface of the hole. This biting action improves the connection strength between the outer surface of the resilient deformation portion and the inner peripheral surface of the through hole.

The first metal plating layer preferably is a copper plating layer.

The second metal plating layer preferably is a tin plating layer.

The invention also relates to the above-described a terminal fitting to be connected a circuit board.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
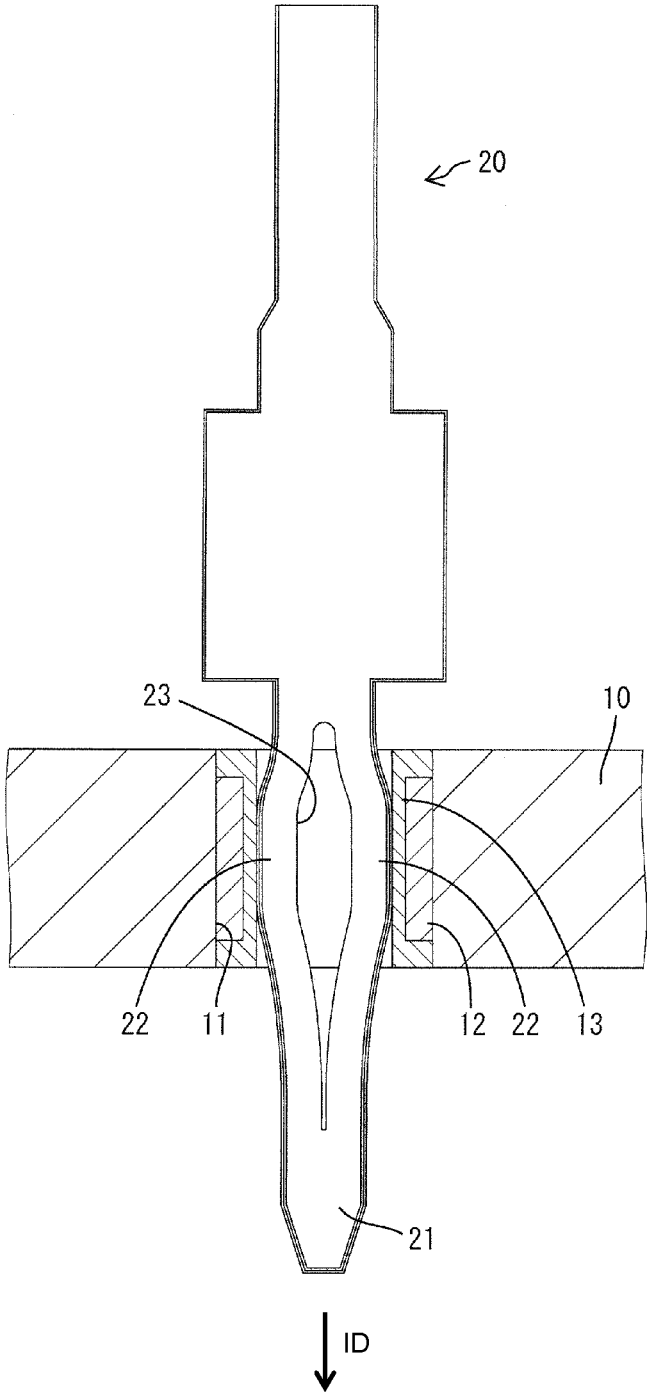
FIG. 1 is a section showing a board connecting portion of a terminal fitting is inserted in a through hole in a first embodiment.

A first embodiment of the invention is described with reference to FIGS. 1 to 2. A circuit board 10 is formed with a through hole 11 that has a substantially circular or rounded (e.g. elliptical) cross section. A conductive layer 12 is formed at least partly on the inner peripheral surface of the through hole 11. A terminal fitting 20 is called a press-fit terminal and is to be connected to the circuit board 10 without using solder. The terminal fitting 20 has a board connecting portion 21 to be press-fit into the through hole 11. The board connecting portion 21 has two substantially symmetrical resilient deformation portions 22 that are spaced apart in a direction substantially perpendicular to an insertion direction ID into the through hole 11. The resilient deformation portions 22 are curved in a substantially arched manner and connected to each other at a base end and a leading end in the insertion direction ID into the through hole 11. A deformation space 23 is formed between the resilient deformation portions 22 for allowing the resilient deformation portions 22 to be deformed resiliently in directions toward each other.

The resilient deformation portions 22 are deformed resiliently to come closer to each other when the board connecting portion 21 is inserted in the through hole 11 and the outer surfaces of the resilient deformation portions 22 are held resiliently in contact with the inner peripheral surface of the through hole 11. Frictional resistance caused by resilient restoring forces of the resilient deformation portions 22 positions the board connecting portion 21 in the through hole 11 and electrically conductively connected to the conductive layer 12 of the circuit board 10.

Connection strength between the terminal fitting 20 and the circuit board 10 is improved by characteristic plating layers 13, 25. More particularly, a board-side tin plating layer 13 is formed on at least parts of the inner peripheral surface of the through hole 11 to cover at least parts of the inner peripheral surface of the conductive layer 12 that will be held in contact with the outer surfaces of the resilient deformation portions 22, and preferably to cover the entire inner peripheral surface of the conductive layer 12.

Figure 2:
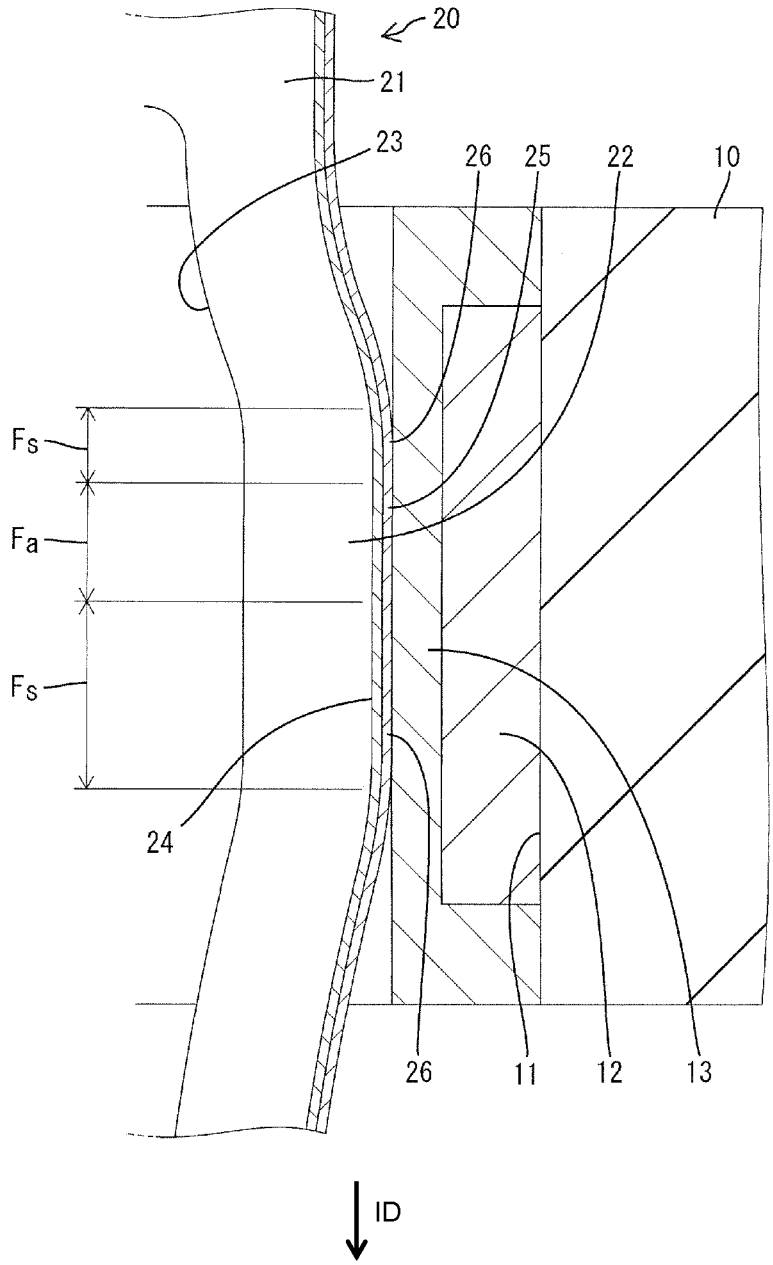
FIG. 2 is an enlarged section showing a connected state of the outer surface of a resilient deformation portion and the inner peripheral surface of the through hole.

On the other hand, as shown in FIG. 2, a first plating layer 24 is formed over substantially the entire outer surface of the resilient deformation portion 22. Further, a copper plating layer 25 and/or terminal-side tin plating layers 26 are formed at least partly on areas of the outer surface of the resilient deformation portion 22 to be held in contact with the inner peripheral surface of the through hole 11 to cover the first plating layer 24. The terminal-side tin plating layers 26 are formed in two separate areas at substantially opposite sides of the copper plating layer 25 in the insertion direction ID into the through hole 11. That is, a first terminal-side tin plating layer 26 is arranged adjacent to and behind the copper plating layer 25 (base end) in the insertion direction ID and a second terminal-side tin plating layer 26 is arranged adjacent to and before the copper plating layer 25 (leading end) in the insertion direction ID.

The copper plating layers 25 contact the board-side tin plating layer 13 when the resilient deformation portions 22 are inserted into the through hole 11 and are pressed by resilient restoring forces of the resilient deformation portions 22. The board-side tin plating layer 13 and the copper plating layers 25 are alloyed by this resilient contact. Out of contact areas between the outer surfaces of the resilient deformation portions 22 and the inner peripheral surface of the through hole 11, Areas where the board-side tin plating layer 13 and the copper plating layers 25 are held resiliently in contact define alloyed areas Fa. The copper plating layers 25 and the board-side tin plating layer 13 are fixed firmly in the alloyed areas Fa. Thus, the inner peripheral surface of the through hole 11 and the outer surfaces of the resilient deformation portions 22 are fixed resiliently in a movement-restricted state. In this way, connection strength between the terminal fitting 20 and the circuit board 10 (holding force for holding the resilient deformation portions 22 so that the resilient deformation portions 22 are not displaced in the through hole 11) is increased.

The terminal-side tin plating layers 26 are held in contact with the board-side tin plating layer 13 when the resilient deformation portions 22 are inserted in the through hole 11 and are pressed by the resilient restoring forces of the resilient deformation portions 22. Areas where the board-side tin plating layer 13 and the terminal-side tin plating layers 26 are held resiliently in contact define good conductive areas Fs having higher conductivity than the alloyed areas Fa. The good conductive areas Fs having high conductivity are provided in addition to the alloyed areas Fa having high fixing strength. Thus the reliability of fixing strength between the circuit board 10 and the terminal fitting 20 is excellent and the reliability of electrical performance is excellent.

Figure 3:
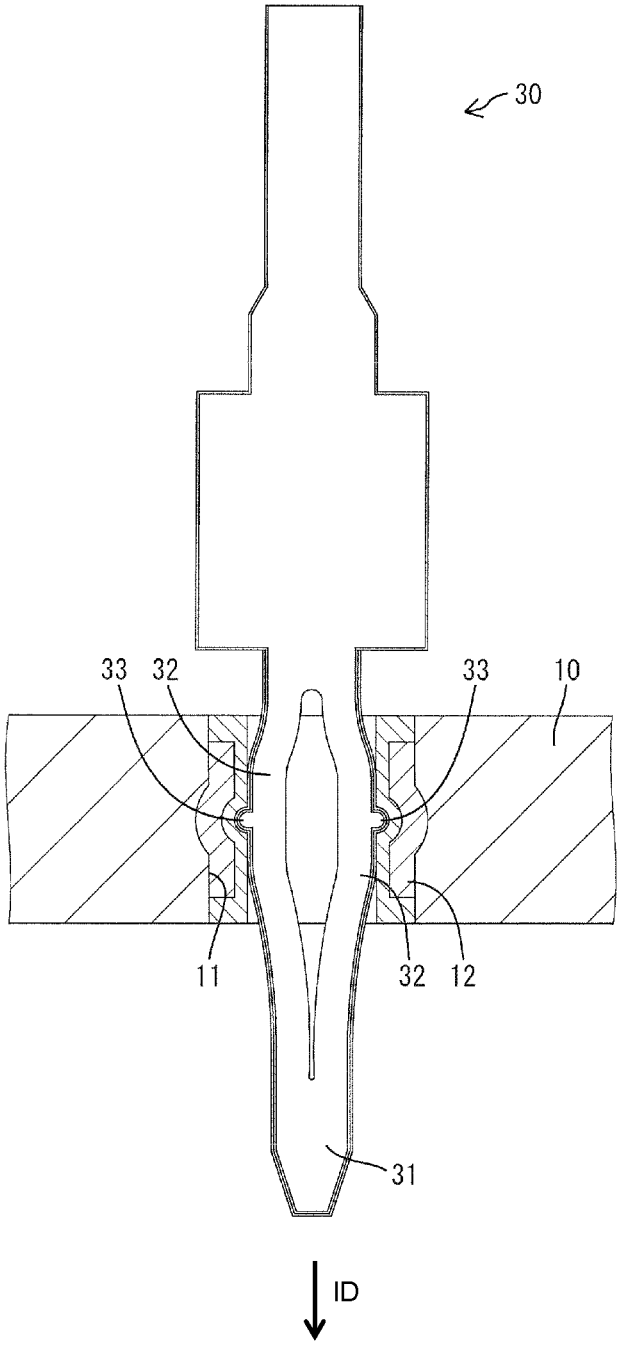
FIG. 3 is a section showing a board connecting portion of a terminal fitting is inserted in a through hole in a second embodiment.
Figure 4:
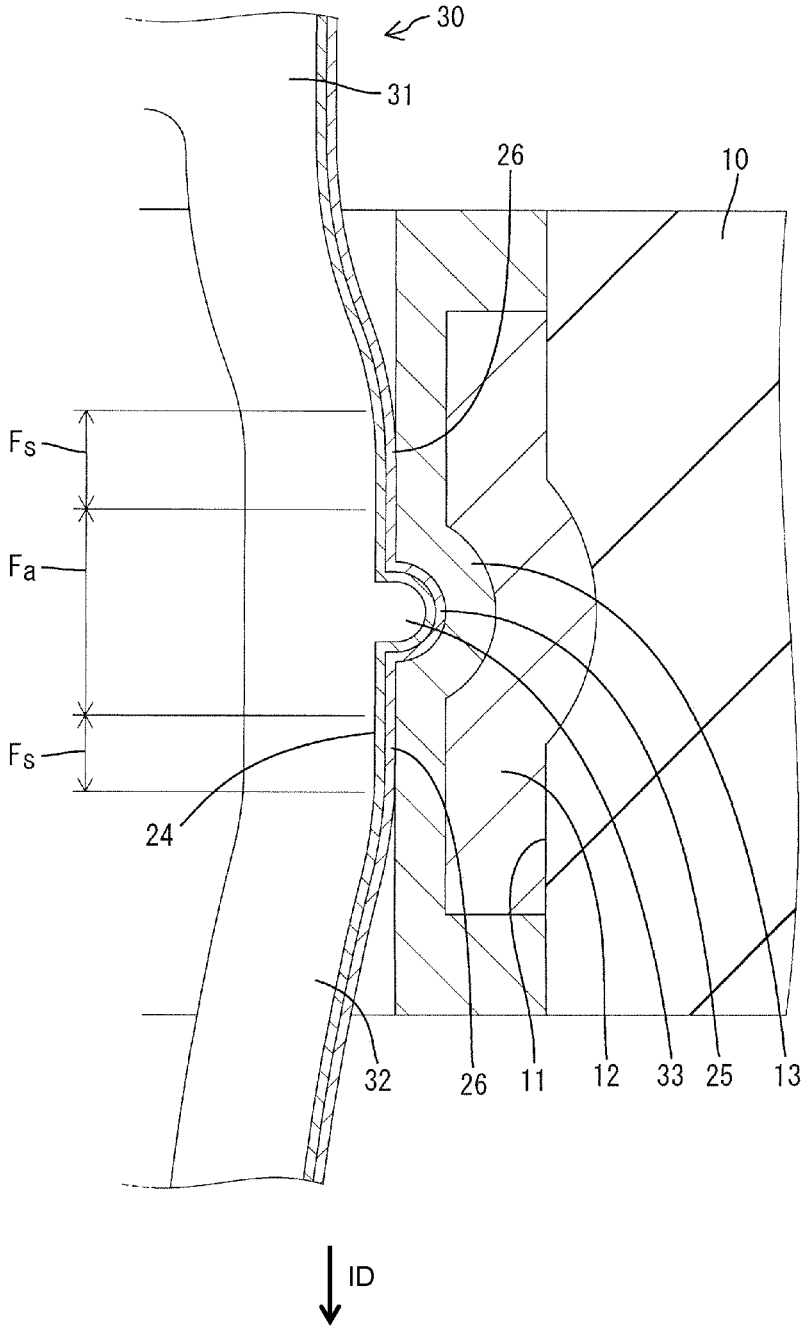
FIG. 4 is an enlarged section showing a connected state of the outer surface of a resilient deformation portion and the inner peripheral surface of the through hole.

A second embodiment of the invention is described with reference to FIGS. 3 and 4. Elements of the second embodiment that are the same as or similar to the first embodiment are denoted by the same reference signs and the structure, functions and effects thereof are not described.

The second embodiment has a terminal fitting 30 with a board connecting portion 31 that includes two resilient deformation portions 32. A projection 33 projects from the outer surface of each resilient deformation portions 32 and contacts the inner peripheral surface of the through hole 11. The projections 33 extend along an alloyed area Fa where a copper plating layer 25 is formed. The projections 33 bite into and engage the board-side tin plating layer 13 and the conductive layer 12 when the resilient deformation portions 32 are inserted in the through hole 11 due to resilient restoring forces of the resilient deformation portions 32. This biting engagement of the projections 33 results in a connection strength between the terminal fitting 30 and the circuit board 10 (holding force for holding the resilient deformation portions 32 so that the resilient deformation portions 32 are not displaced in the through hole 11) that is higher than in the first embodiment.

The invention is not limited to the above described embodiments. For example, the following embodiments also are included in the scope of the invention.

The resilient deformation portions are formed with the copper plating layers and the through hole is formed with the tin plating layer to be alloyed with the copper plating layers in the above embodiments. However, the through hole may be formed with a copper plating layer and the resilient deformation portions may be formed with tin plating layers to be alloyed with the copper plating layer.

The good conductive areas formed by the contact of the tin plating layers are near the alloyed areas in the above embodiments. However, the entire contact areas between the resilient deformation portions and the through hole may be alloyed areas.

Good conductive areas are formed at opposite sides of the alloyed area in the insertion direction ID of the board connecting portion into the through hole in the above embodiments. However, alloyed areas may be formed at opposite sides of a good conductive area.

The projection is formed only in the alloyed area where the copper plating layer is formed in the second embodiment. However, it may be formed only in the area where the terminal-side tin plating layer is formed or may be formed both in the alloyed area where the copper plating layer is formed and the good conductive area where the terminal-side tin plating layer is formed.

What is claimed is:

1. A connection structure, comprising:

a circuit board formed with at least one hole having an inner periphery and a first metal plating layer made of a first metal formed on the inner periphery of the at least one hole;

a terminal fitting with a board connecting portion formed with resilient deformation portions that are resiliently deformable in directions intersecting an inserting direction of the terminal fitting into the hole and resiliently held in contact with the inner periphery of the hole when the board connecting portion is inserted in the hole;

a second metal plating layer made of a second metal being formed in an area of the outer surface of each resilient deformation portion to be resiliently held in contact with the inner periphery of the hole and alloyed with the first metal plating layer for holding the board connecting portion in the hole; and at least one third metal plating layer made of the first metal and formed in at least one area of the outer surface of each resilient deformation portion to be resiliently held in contact with the inner periphery of the hole and being substantially adjacent to the second metal plating layer, the third metal plating layer contacting the first metal plating layer and forming a conductive area having higher conductivity than an alloyed area formed by resilient contact of the first metal plating layer and the second metal plating layer.

2. A terminal fitting to be connected a circuit board, comprising:

at least two resilient deformation portions spaced from one another and extending along an extending direction of the terminal fitting, at least parts of the resilient deformation portions being resiliently deformable toward one another, the resilient deformation portions having outer surfaces facing away from one another, first and second metal plating layers made of first and second metals that are different from one another being formed on the outer surface of each resilient deformation portion and arranged alternatingly in the extending direction.

3. The connection structure according of claim 1, further comprising at least one projection formed on the outer surface of the resilient deformation portion, the projections biting into and engaging the inner peripheral surface of the hole.

4. The connection structure of claim 1, wherein the first metal plating layer is a tin plating layer.

5. The connection structure of claim 1, wherein the second metal plating layer is a copper plating layer.

6. A connection structure, comprising:

a circuit board formed with at least one hole having an inner periphery and a first metal plating layer made of a first metal formed on the inner periphery of the at least one hole;

a terminal fitting with a board connecting portion formed with resilient deformation portions that are resiliently deformable toward one another and in directions intersecting an inserting direction of the terminal fitting into the hole, the resilient deformation portions having outer surfaces resiliently held in contact with the inner periphery of the hole when the board connecting portion is inserted in the hole;

a second metal plating layer made of a second metal different from the first metal being formed in an area of the outer surface of each resilient deformation portion to be resiliently held in contact with the inner periphery of the hole and alloyed with the first metal plating layer when the board connecting portion is inserted in the hole for holding the board connecting portion in the hole; and at least one third metal plating layer made of the first metal and formed in at least one area of the outer surface of each resilient deformation portion to be resiliently held in contact with the inner periphery of the hole and substantially adjacent to the second metal plating layer, the third metal plating layer contacting the first metal plating layer and forming a conductive area having higher conductivity than an alloyed area formed by resilient contact of the first metal plating layer and the second metal plating layer.

7. The terminal fitting of claim 2, wherein the second metal plating layer is a tin plating layer.

8. The connection structure of claim 6, wherein the first metal is tin.

9. The connection structure of claim 8, wherein the second metal is copper.

10. The terminal fitting of claim 2, wherein the second metal plating layer is a tin plating layer.

11. The terminal fitting of claim 2, further comprising at least one projection (33) formed on the outer surface at least one of the resilient deformation portions.

12. The terminal fitting of claim 2, wherein the first metal plating layer is a copper plating layer.

* * * * *